US010059499B2

(12) United States Patent
Roesler et al.

(10) Patent No.: US 10,059,499 B2
(45) Date of Patent: Aug. 28, 2018

(54) INDIVIDUAL PACKAGE THAT CAN BE ARRANGED SIDE-BY-SIDE IN A ROW WITH LABEL STRIPS FOR A MEDICALLY TIGHT CLOSURE

(71) Applicants: Peter Roesler, Wangen (DE); Thiemo Roesler, Wangen (DE); Wolfgang Sohler, Wangen-Neuravensburg (DE)

(72) Inventors: Peter Roesler, Wangen (DE); Thiemo Roesler, Wangen (DE); Wolfgang Sohler, Wangen-Neuravensburg (DE)

(73) Assignee: Roesler IP GmbH (DE)

( * ) Notice: Subject to any disclaimer, the term of this patent is extended or adjusted under 35 U.S.C. 154(b) by 0 days.

(21) Appl. No.: 15/422,828

(22) Filed: Feb. 2, 2017

(65) Prior Publication Data

US 2017/0225861 A1 Aug. 10, 2017

(30) Foreign Application Priority Data

Feb. 4, 2016 (DE) ..... 10 2016 001 276

(51) Int. Cl.

| | |
|---|---|
| ***B65D 75/52*** | (2006.01) |
| ***B65D 25/20*** | (2006.01) |
| ***B65D 75/38*** | (2006.01) |
| ***B65C 9/18*** | (2006.01) |
| ***B65C 3/08*** | (2006.01) |
| ***B65D 21/02*** | (2006.01) |
| ***B65C 1/04*** | (2006.01) |

(Continued)

(52) U.S. Cl.

CPC ..... *B65D 75/527* (2013.01); *B65C 1/04* (2013.01); *B65C 3/08* (2013.01); *B65C 9/1865* (2013.01); *B65D 21/0204* (2013.01); *B65D 21/0206* (2013.01); *B65D 25/205* (2013.01); *B65D 75/38* (2013.01); *G09F 3/0341* (2013.01); *B65C 2009/0021* (2013.01)

(58) Field of Classification Search

CPC ..... B65D 75/527; B65D 21/0204; B65D 21/0206; B65C 1/04; B65C 3/08; B65C 9/1865

USPC ..... 206/5.1, 504, 459.5

See application file for complete search history.

(56) References Cited

U.S. PATENT DOCUMENTS 3,983,999 A * 10/1976 Morton ..... B65D 21/0206 206/526
5,024,067 A * 6/1991 Maier, II ..... B65D 21/0204 220/23.4

(Continued)

FOREIGN PATENT DOCUMENTS

DE 4409819 B4 9/1994
DE 20212076 U1 11/2002

(Continued)

*Primary Examiner* — Chun Cheung
(74) *Attorney, Agent, or Firm* — Cohen & Grigsby, PC

(57) ABSTRACT

Package block (3, 5) consisting of individual packages (1, 2) that are mechanically coupled together and can be separated from one another by a shear force acting along the respective parting joint (11) and can be sealed medically tight at least in the vicinity of their container openings (14) by a continuous label strip (17), wherein the continuous label strip (17) consists of individual labels (18-20) connected to one another across parting edges (32), and that the parting edges (32) are aligned with the parting joints (11) between the individual packages (1, 2).

15 Claims, 8 Drawing Sheets

(51) Int. Cl.
*G09F 3/03* (2006.01)
*B65C 9/00* (2006.01)

(56) References Cited

U.S. PATENT DOCUMENTS

| | | | | | |
|---|---|---|---|---|---|
| 5,409,127 | A | | 4/1995 | Stratford et al. | |
| 5,620,087 | A | * | 4/1997 | Martin | B65B 25/008 206/459.5 |
| 5,697,495 | A | * | 12/1997 | Abrams | B65B 25/008 134/901 |
| 2002/0117405 | A1 | * | 8/2002 | Wang | B65B 25/008 206/5.1 |
| 2004/0031718 | A1 | * | 2/2004 | Peng | B65D 75/327 206/531 |
| 2007/0000792 | A1 | * | 1/2007 | Newman | A45C 11/005 206/5.1 |

FOREIGN PATENT DOCUMENTS

| | | | |
|---|---|---|---|
| DE | 102012013927 | | 1/2014 |
| JP | 2003226386 | A | 8/2003 |
| WO | 2015047684 | A1 | 4/2015 |

* cited by examiner

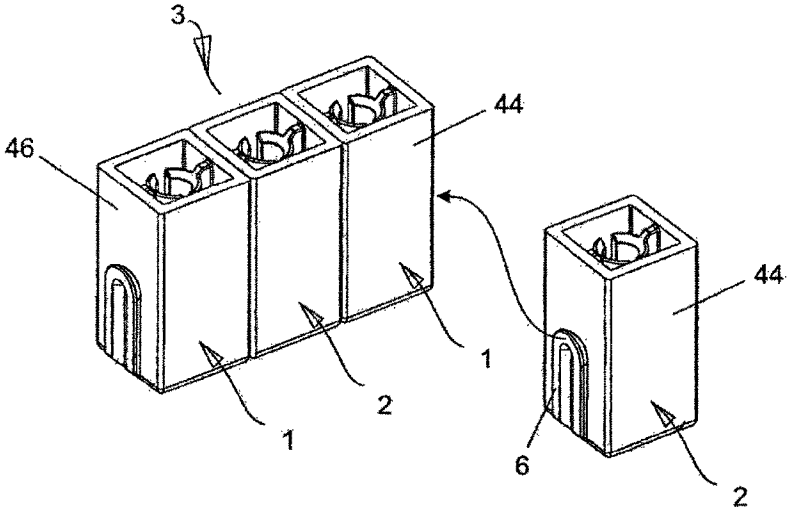
Fig. 5
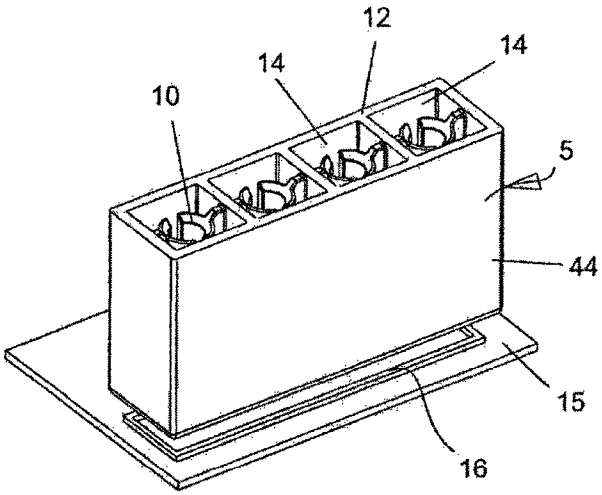
Fig. 6
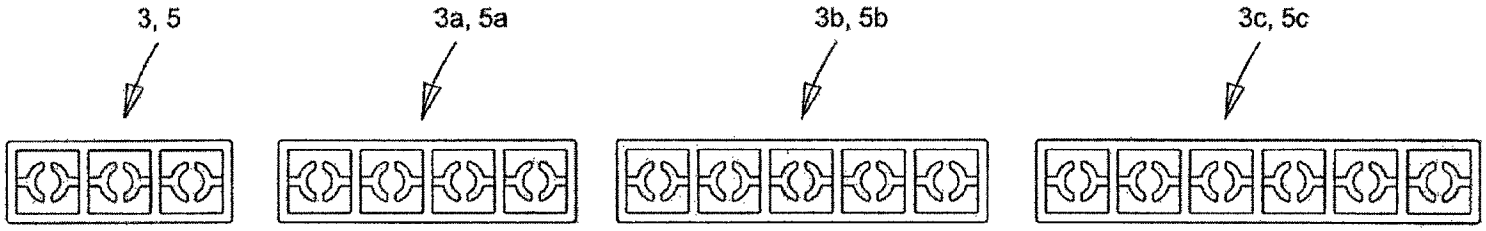
Fig. 10
Fig. 9
Fig. 8
Fig. 7

INDIVIDUAL PACKAGE THAT CAN BE ARRANGED SIDE-BY-SIDE IN A ROW WITH LABEL STRIPS FOR A MEDICALLY TIGHT CLOSURE

BACKGROUND OF THE INVENTION

Field of the Invention

The object of the invention is an individual package that can be arranged side-by-side in a row with label strips for the medically tight closure of the individual packages. Individual package means and individual packing sleeves made of plastic, which can consist of a hard plastic material, for example, and which is open on one side, whereby the object contained in the package can be accessed via this opening.

Discussion of the Prior Art

Individual packages that can be arranged side-by-side in rows are widely known in the prior art. Reference is made, for example, to the subject matter of FR 2 622 174 A1 or WO 99/17 910 A1.

One feature of these individual packages is that as many individual packages as desired can be connected with one another with mechanically detachable connecting means and each individual package can be detached from the neighboring individual package by a pulling or counter-rotation movement.

The inventions of the prior art also include package blocks, wherein each package block consists of individual packages, but in which the individual packages in the package block itself can no longer be separated from one another. Packaging blocks of this type with individual packages that are permanently connected to one another can then also be line up side-by-side and connected with one another and can form as many packing lengths as desired.

For reasons of simplification, the following description of the prior art invention describes only individual package that can be lined up side-by-side in a row, although the teaching of the invention also includes other package blocks that can be arranged side-by-side with one another and mechanically coupled to one another by connecting means.

In the storage of small medical instruments, supplies and apparatus, it is frequently necessary to store each medical supply, device or accessory in its own, medically sealed packaging. Taking implant screws as an example, it can be shown that an implant screw of this type is located in an individual hard plastic package and is held in a clamping device located in the interior of the package. Medical regulations require that each individual package be provided with a separate label, and there are additional label holders and detachable adhesive labels that can be detached from the packaging label and adhesively attached in another location, such as on a recording medium, for example.

It has been found that for economic reasons it is not possible to provide each individual package with a separate label, because the attachment of separate labels on very small individual packages is complex and time-consuming and involves high costs for the orientation equipment. It is more efficient to adhesively attach a continuous label strip to a plurality of individual packages that are aligned with one another to form a packaging block to ensure that the label strip covers all the individual packages. During the application of a label strip that covers a plurality of individual packages lined up side-by-side with one another, it is also possible to use a serial label strip, in which the first individual package bears a number that is different from the last individual package in this packaging strip, for example of other individual packages lined up side-by-side in a row.

The same description applies for packaging blocks, with the sole distinction that in a packaging block there are a plurality of individual packages that cannot be separated from one another, although they are also covered by a common adhesive label, and a plurality of packaging blocks lined up side-by-side in a row can in turn be labeled with one continuous label strip.

Various problems have been encountered in the use of continuous label strips not separated from each other and that are to be positioned accurately over a plurality of individual packages or packaging blocks lined up side-by-side in a row.

SUMMARY OF THE INVENTION

It is the object of the invention to create an individual package that can be lined up side-by-side in a row and covered with a continuous label strip for the medically sealed closure of the individual packages, wherein the label strips cover a plurality of individual packages and, when the individual packages are separated from the packaging block, a clean separation of the individual label from the label strip is guaranteed.

The first requirement is accordingly that the label strip must be adhesively attached to the front side of the row of packages with a precise fit, so that when the individual packages that are connected to one another by the detachable connection means, it is ensured that the parting joint between the individual packages with the perforation line or the cutting line is oriented in alignment with the label strip. The purpose of this measure is to ensure that when the one individual package is separated from the mechanical assembly of the packaging block, the individual label adheres securely and without tearing to the individual package, without residual parts of this individual label adhering to the remaining packaging block.

Accordingly, the label on the individual package is torn off cleanly and smoothly from the rest of the label on the packaging block of the individual packages lined up side-by-side in a row.

A second requirement is that the container opening of the individual packages that is open on one side toward the top must be closed by the individual label to produce a medically tight seal of the container.

A third requirement is that at least the part of the individual label that closes the container opening allows a sterilization of the interior of the container. This part of the label is referred to below as the closing sheet.

According to the invention, the sterility of the interior of the container is not an absolute necessity. Aseptic or almost germ-free conditions are sufficient. For that purpose, it is necessary for the closing sheet of the label—the part that closes the container opening—to be applied on all sides and so that it creates a seal around the top surrounding edge of the container to prevent the penetration of germs into the container.

The seal of the container opening must be one that is particularly tight and secure against tearing forces. The adhesive connection must also be secure and designed so that when the individual packages are separated from one another, it can be ensured that during the separation process the tight seal of the individual label with the closing sheet that seals the surrounding container edge is not broken. Therefore, different requirements must be met with regard to the separation force of the individual label with reference to the front side of the individual label and the upper side of the individual label in the vicinity of the closing sheet that closes and seals the container opening.

The connection between the cover-side closing sheet and the sealing surface on the upper side of the individual package must guarantee that the connection is preserved even during the separation of the individual packages when the label strip is separated along with the individual package.

When a label strip of this type that consists of individual labels that are separated from one another by means of cut, separation or perforation lines, the different types of requirements described above must be met.

A label strip of this type with individual labels can have different shapes.

In the first embodiment, the base material or the base backing of the label consists of a vapor-permeable and/or gas-permeable membrane-like material that is commercially available under the tradename "Tyvek" and that is characterized by the fact that it is a sort of fleece that can be sterilized and is vapor permeable. It is thereby possible to sterilize the individual packages closed with a label material of this type and lined up side-by-side with each other in a plug-in assembly in the vicinity of the closing sheet, because the sterilization means can diffuse through the closing sheet but cannot penetrate outward from the interior of the container. Therefore, this is a membrane material that is used according to the invention for a label strip consisting of individual labels that are lined up side-by-side with one another in a row and can be separated from one another.

In another configuration of the invention, the label strip consists of a paper-like base backing that is more or less fleece-like and consists of a fleece-like polyethylene plastic, wherein this fleece consists of extremely fine filaments. Consequently, this membrane-like material is a textile product consisting of fibers.

The invention is not restricted to the use of a textile membranous film or a fleece material, but all other film-like labels are also claimed with which it is possible to make the closing sheet that permeably covers the container opening of the individual package so that it is permeable for sterilization means from the outside to the inside. That is, biological materials, such as organic cell aggregates, for example, cannot diffuse through a membrane closing sheet of this type.

The advantage of the invention lies in the fact that an individual package that can be lined-up side by side is designed so that a label strip can be adhesively applied to it and so that the label strip, in the top encircling edge, provides reliable closure and adherence, and also on the front side and optionally also on the reverse side forms additional adhesive surfaces with which the label strip can be glued to the front side and back side of the packaging block.

The closing sheet that closes the container opening, which is open on top, in a sealed manner is membranous over its entire cross section (permeable in one direction for specified substances).

In an additional configuration of the invention, to cite only one example, only a spot area in the vicinity of this closing sheet is provided, through which the sterilization measures described above can take place.

The object of the invention is accomplished by the features of the technical teaching, wherein a package block comprising individual packages that can be mechanically coupled and separated from one another by a shear force acting along a respective parting joint and can be sealed medically tight at least proximate to individual package openings by a continuous label strip, wherein the continuous label strip comprises individual labels connected to one another across parting edges, the parting edges aligned with parting joints between the individual packages One feature of the invention is that the individual package is associated with a label strip that consists of individual labels lined up in a row, wherein the individual labels lined up with one another are connected with one another by means of a continuous parting edge, wherein the adherence properties of the individual labels to the surfaces of the individual package, in connection with the continuous parting edge, are selected so that in the vicinity of the closing sheet that covers the container opening, the parting edge can be separated in the vicinity of this container-opening-side parting edge on the closing sheet without adversely affecting the adherence of the closing sheet to the encircling container opening.

Consequently, different requirements are set for the adhesive strength and the parting strength applied in the shear direction for the label strip in the vicinity of the continuous parting edge.

In one preferred embodiment, the individual packages that can be lined up side-by-side in a row with one another can be separated from one another in the direction of their longitudinal axis, i.e. a counter-rotation movement takes place during the separation of the individual package from the lateral surface of the packages that form a packaging block.

The purpose of this shear motion is to tear the edge part of the label located on the front side without leaving residue on the facing label. This shear force is favorable for the separation of this forward edge part of the individual label, although it is counterproductive with reference to the separation action in the vicinity of the closing sheet that seals the container opening. Specifically, the closing sheet is undesirably lifted up when the edge sides of the individual packages are pushed together, which tends to life the sealing edge and to adversely affect the sealed closure. For this reason, in the vicinity of the coversheet, on the edge part that runs there, care must be taken that the edge part can be separated particularly easily without the seal on the container opening being broken during the separation and the related lifting of the covering sheet.

Analogous to the way in which the edge part located on the front side, which tears off easily with a counter-rotation movement of the individual packages, this is also true for the portion of the label that is optionally located on the backside, which can also have an edge part located there, which is in the form of a perforation line or an incised discontinuous line, and which tears particularly easily, because the shear forces that occur when the individual packages are counter-rotated act on the perforation lines directly parallel and in the same plane in the sense of a breaking motion.

The problem addressed by the invention is therefore the undesirable lifting of the covering sheet that closes the container opening when the individual packages sealed by the label strips are counter-rotated.

This problem is also solved by an additional embodiment of the invention, which is based on the fact that the label strip consists of a plurality of individual labels that are already separated from one another by cut lines. The problem of the ragged separation of the individual labels when a labeled individual package is detached from the package block therefore no longer exists because the individual labels are a priori already separated from one another.

The packaging block consists of mechanically coupled individual packages that can be separated from one another by a shear force that acts along the respective parting joint and that can be sealed medically tight at least in the vicinity of their container openings by a continuous label strip, wherein the continuous label strip consists of individual labels separated from each other by cutting lines, wherein the cutting lines of the individual labels are aligned with the parting joints between the individual packages and whereby an auxiliary strip is adhesively connected to the upper side of the individual labels at least as long as they are not yet sealed on the container openings of the packaging block.

All the individual labels described above can be used. One problem with this labeling is that the individual labels separated from one another must be fixed in position at least temporarily by one or more adhesive auxiliary strips until they have been sealed with their covering sheet on the encircling container openings of the individual packages. For this reason, a novel labeling method for labeling a packaging block with a continuous label strip is characterized by the following steps:

1) the individual labels connected with each other along their longitudinal edges are separated from one another along cut lines, 2) to secure the separated individual labels in position, at least one auxiliary strip is adhesively attached to the upper side of the separated individual labels before, during or after the separation, 3) the individual labels held together in secure positions by means of an auxiliary strip are laid with the sealable covering sheets on the container openings of the packaging block and sealed, 4) the additional adhesive parts of the individual labels are adhesively attached with appropriate applicator tools on the front and optionally the back side of the individual packages, and 5) the at least one auxiliary strip is removed before or during or after the previous step.

All of the explanations provided above apply for the individual labels used here and the label strips derived from them.

The subject matter of the present invention is derived not only from the subject matter of the individual patent claims but also from the combination of the individual patent claims with one another.

All the information and features disclosed in the documents, including the abstract, and in particular the three-dimensional embodiment depicted in the drawings, are hereby claimed as essential to the invention inasmuch as they are novel individually or in any combination in comparison with the prior art.

Inasmuch as individual features are referred to as "essential to the invention" or "important," that does not mean that these features necessarily must form the subject matter of an independent claim. That is determined only by the respective valid version of the independent patent claim.

BRIEF DESCRIPTION OF THE DRAWINGS

The invention is explained in greater detail below on the basis of drawings, which illustrate only one exemplary embodiment. Additional features that are essential to the invention and advantages of the invention can be derived from these drawings and the description thereof.

In the figures:

FIG. 5 shows an embodiment that is approximately the same as FIG. 1, and shows how an individual package is detachably aligned in the packaging block.

FIG. 6 shows a variant form of the embodiment illustrated in FIG. 5.

FIGS. 7-10 illustrate different packaging blocks of different lengths, which can consist either of individual packaging blocks arranged side-by-side in a row as illustrated in FIG. 6 or of individual packages as illustrated in FIG. 5.

DESCRIPTION OF A PRESENTLY PREFERRED EMBODIMENT

Figures 1, 2, 3, 4, 11, 12, 13:
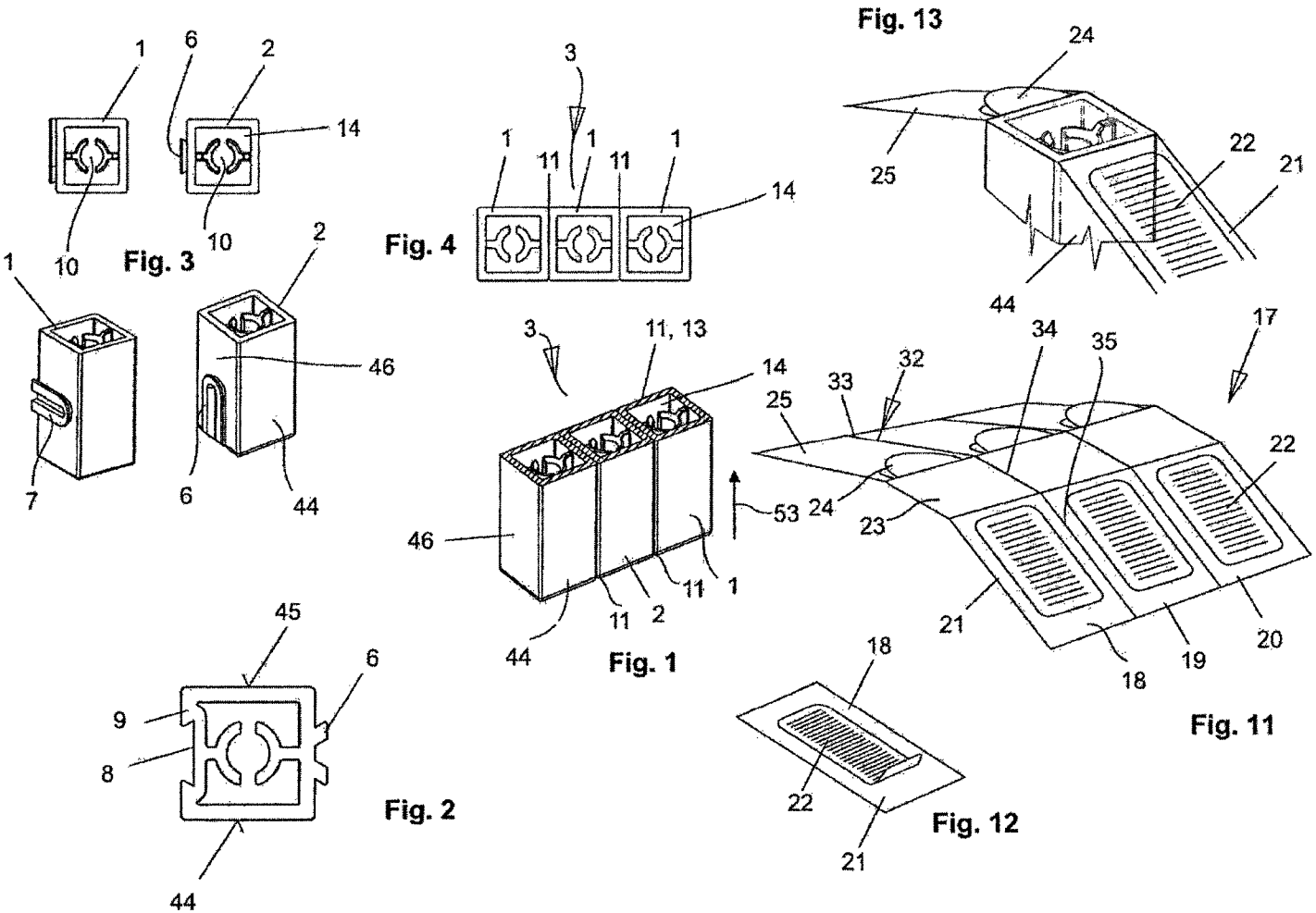
FIG. 1 is a view in perspective of a packaging block that consists of three individual packages line up side-by-side with one another in a row and that can be detached from one another.
FIG. 2 is a plan view of the individual package illustrated in FIG. 1.
FIG. 3 is a view in perspective of two different embodiments of individual packages with laterally different connecting means.
FIG. 4 is a plan view of the arrangement illustrated in FIG. 1.
FIG. 11 is a view in perspective of a first preferred embodiment of a label strip.
FIG. 12 is a schematic illustration of an identification strip that can be lifted from the label strip 17 of an individual label.
FIG. 13 is a schematic illustration of the application of a label strip which for reasons of simplification shows only the application of an individual label to an individual package.

FIG. 1 is a general view of a packaging block 3 that consists of individual packages 1, 2 lined up side-by-side in a row with one another. Between the individual packages 1, 2 there are parting joints 11, and each individual package 1, 2 has a front side 44 and a lateral surface 46, wherein the front side 44 is opposite a back side 45.

The sleeve-like individual packages 1, 2 each form a container opening 14 that is open on the top, and in the interior of the container opening 14—by way of example—a push-in holder 10 to hold medical implant screws is shown.

The lateral connecting means between the individual packages 1, 2 can be configured in a number of different ways.

In the exemplary embodiment illustrated in FIG. 3, the right side of the figure shows that a connecting element 6 that is open on the bottom has lateral lugs as illustrated in FIG. 2 and can be inserted into a corresponding undercut groove 8 of a mating element 9.

Instead of a connecting element 6 open on the bottom as shown on the right side in FIG. 3, there can also be a connecting element 7 that is open on the back.

The configuration of the mating connecting means that can be easily detached from each other by a relative force between the individual packages 1, 2, can be anything that is desired. Various other connecting means of the prior art can also be used, such as those that are described, for example, in WO 99/17 910 A1 or in US 2002/0079313 A1.

While FIG. 5 illustrates the connection principle of the individual packages 1, 2 illustrated in FIGS. 1 and 4, FIG. 5 shows that each individual package can be lined up side-by-side in a row with a movement in the direction of the arrow with the lateral surface 46 of the existing packaging block 3.

As a variant of this design, FIG. 6 shows that a plurality of individual packages can also form a cohesive packaging block 5, and that individual packaging blocks 5 can be connected with one another side-by-side in a row by means of the mechanical connecting means 6, 8, 9, as illustrated in FIG. 5.

Accordingly, FIGS. 7 to 10 all show different possible combinations that can be used to continue the individual packages shown there in the form of packaging blocks 5, 5*a*, 5*b*, 5*c* in any desired fashion.

While FIGS. 7 to 10 show individual packaging blocks 5, 5*a*, 5*b*, 5*c* of different lengths, it will be clear to a person skilled in the art that the different length packaging blocks 5, 5*a*, 5*b*, 5*c* can also be connected to one another side-by-side in a row with the mechanical connecting means illustrated in FIG. 5 and separated from one another.

FIG. 6 also shows that the packaging blocks formed from a plurality of individual packages can be attached to a holding plate 15, for which purpose a board frame 16 can be used.

FIG. 1, in comparison to FIG. 3, shows that the upper surrounding container opening 14 can be provided with an additional coating 13 before the application of associated label strips 17 (see FIG. 11). Therefore, the container edge 12 is in the form of the sealing surface.

FIG. 11 shows as a first exemplary embodiment a label strip 17 that consists of a plurality of individual labels 18, 19, 20 that are connected to one another, each of which is detachably separated by means of parting edges 32.

As indicated in the general description, there are special difficulties in separating an individual package 1 in the direction of the arrow 53 from the rest of the group of individual packages, because the shear movement (relative movement between the individual package 1 and 2 in the vicinity of the parting line 11) must also tear the parting edge 32 of the label strip 17.

As explained below, there are no particular problems with regard to the front edge portion 35 and the rear edge portion 33, because these are moved by the shear motion in the same plane relative to each other and tear off easily. The problem consists in the separation of the upper edge portion 34, which relates to the closing sheet 23 of the label strip. This closing sheet 23 must specifically adhere to the encircling container edge 12 absolutely securely and in a sealed manner and may not be lifted by the resulting thrust force in the direction of the arrow 53.

The invention therefore teaches the measures described below as solutions to the aforementioned problems.

The label strip 17 illustrated in FIG. 11 consists of a fibrous fleece-like, membranous textile material that is commercially available under the tradename "Tyvek". Adhesively attached to the backing 21, on the front side, are one or more identification strips 22 that can also be detached as illustrated in FIG. 12.

The closing sheet 23 and the backing 21 are made of a single piece of material and are continued toward the rear into an additional backing 25 on the back side. On this rear backing 25, a pull tab 24 can be formed which projects beyond the backing 25, as illustrated in FIG. 13.

It is possible to detach the pull tab 24 together with the backing 25 from the back side of the container, or only to tear off the pull tab 24 by itself, and thus also the closing sheet 23, whereby the closing sheet 23 remains connected to the backing 21 along a folded edge 28.

In another configuration, the folded edge 28 can also be in the form of a perforation edge to guarantee that the closing sheet 23 can be pulled completely off the backing 21, and the backing 21 then remains adhering to the front side 44 of the individual package.

Figures 14, 14A, 15, 18:
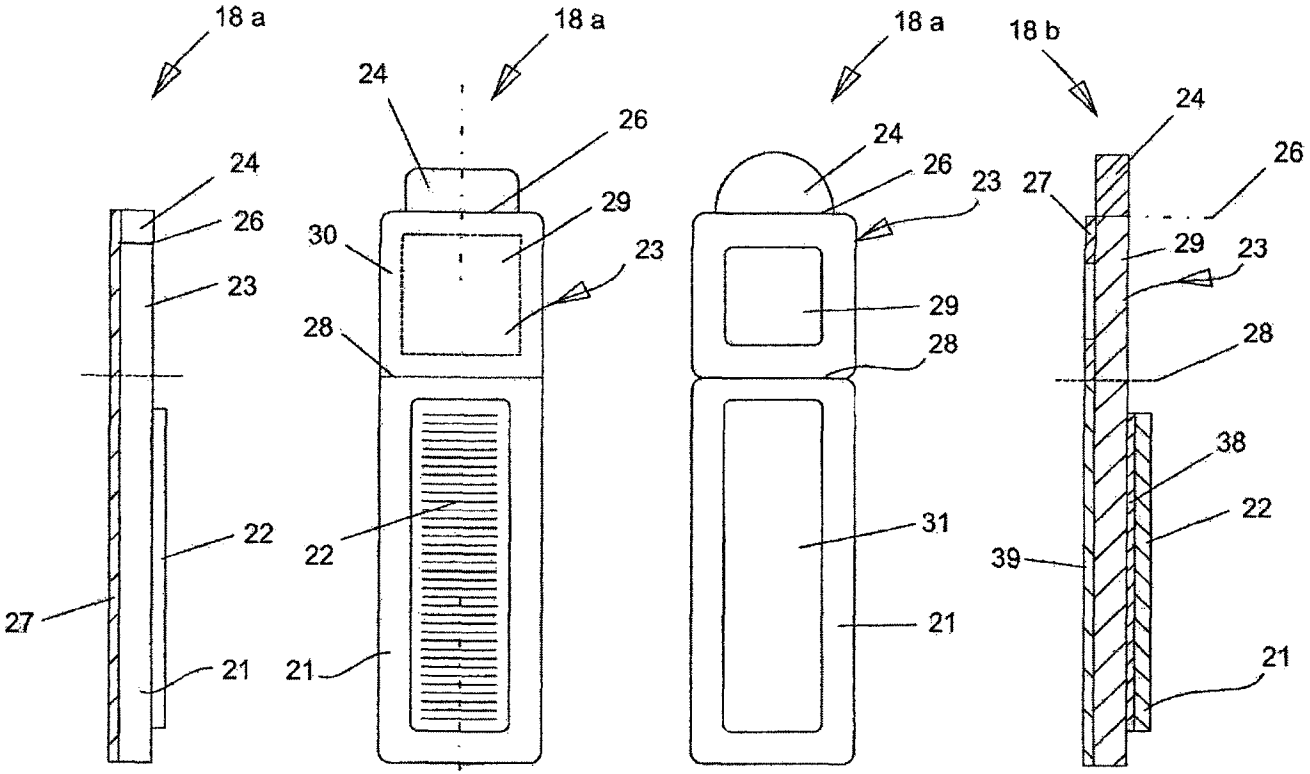
FIG. 14 is a plan view of a second embodiment of an individual label.
FIG. 14*a* is a cross-section along the center line in FIG. 14.
FIG. 15 shows the back side of the individual label illustrated in FIG. 14.
FIG. 18 is a section through another embodiment of the adhesive and sealing labels on the individual label.

FIGS. 14, 14*a* and 15 illustrate a second exemplary embodiment of the label strip 17 which consists of a different type of individual label 18*a*. A plurality of individual labels 18*a* then also form a label strip which, for purposes of illustration only, is shown not connected together. Accordingly, FIGS. 14 to 18 describe only an individual label.

FIG. 14 shows that the second embodiment of an individual label 18*a* of this type consists of a backing 21, to the front side of which an identification strip 22 is adhesively attached. The backing 21 transitions toward the closing sheet 23 across a folded edge 28 into the closing sheet 23, wherein the figure shows that located in the vicinity of the closing sheet 23 there is a middle membrane area 29 that can be square, rectangular or round.

The membrane surface 29 can be any desired shape and is characterized by the fact that it does not have an adhesive layer either on the top side or on the back side, to guarantee a membranous entrance to the container opening 14 and the interior of the individual package 1.

The surrounding edge that extends around the membrane surface 29 is called the peripheral area 30, and can be coated on its back side with a sealing varnish or another adhesive.

Adjacent to the top side of the closing sheet 23 is a pull tab 24. It does not have the rear backing 25 that is illustrated in FIG. 11. Accordingly, this individual label does not extend across the back side 45 of the individual package.

FIG. 14 shows that the membrane surface 29 is uncoated and forms an open passage for vapor or gas sterilization means.

FIG. 14*a* shows a section along the center longitudinal line through FIG. 14, with a slight variation. First, the figure shows that the entire back side of the individual label 18*a* is provided with a sealable coating 27 which consequently also extends over the membrane surface 29. If the thickness of the coating 27 is not too great, at the same time a free passage of vapor or gas sterilization means through the membrane surface 29 and through the coating 27 that closes this membrane surface is guaranteed.

Therefore, two different embodiments are illustrated, wherein in the first embodiment the membrane surface 29 is uncoated, while in the second embodiment illustrated in FIG. 14*a* the membrane surface is closed with the sealable coating 27.

The identification strip 22, which can also be provided with an adhesive layer 38 as illustrated in FIG. 18, is adhesively attached to the front side—in the vicinity of the backing 21.

FIG. 15 shows the back side of the individual label illustrated in FIG. 14, and shows that on the back side there is an open space 31 that can be provided with an adhesive layer, although that is not necessary.

FIG. 18 shows a section through the exemplary embodiment illustrated in FIG. 14, and shows that the sealable coating 27 does not extend over the membrane surface 29, but leaves it uncoated.

Otherwise, the same reference numbers are used for the same parts, wherein it should also be added that the pull tab 24 is connected by means of a folded edge 26 with the material of the backing sheet 21.

FIG. 18 also shows that in the vicinity of the closing sheet 23 there is a sealable coating 27 that ensures an absolutely tight closure with the encircling container opening 14, while in the same plane, but below it and on the back side of the backing sheet 21, there is a different type of coating 39 which is preferably in the form of a simple adhesive layer. However, this coating 39 does not have to be sealable. No adhesive layer is applied to the backside of the pull tab 24, to make it easily accessible.

Figure 16:
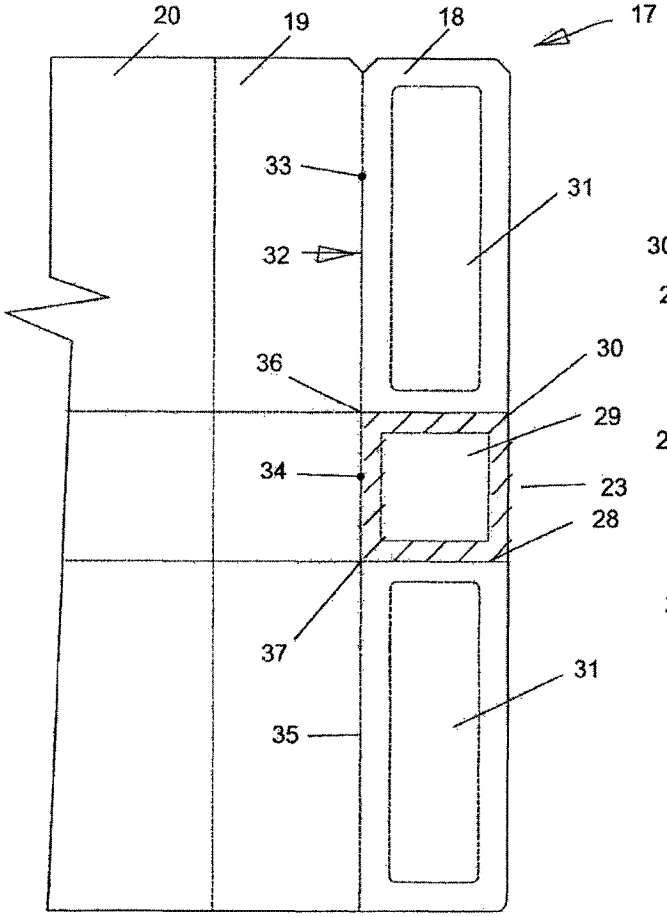
FIG. 16 is a plan view of the second embodiment of a label strip.

FIG. 16 shows the label strip 17 illustrated in FIG. 11 in a plan view, and shows that the individual labels 18, 19, 20 that are connected to one another are connected to one other by means of vertical parting edges 32. Each parting edge 32 is divided into the top edge part 33, the middle edge part 34 and the bottom edge part 35.

The edge parts 33 and 35 have the same parting characteristics, while the middle edge part 34 has a different parting characteristic.

The figure also shows that in the vicinity of the closing sheet 23, there is a peripheral area 30 with a high-strength sealable coating.

Figure 17:
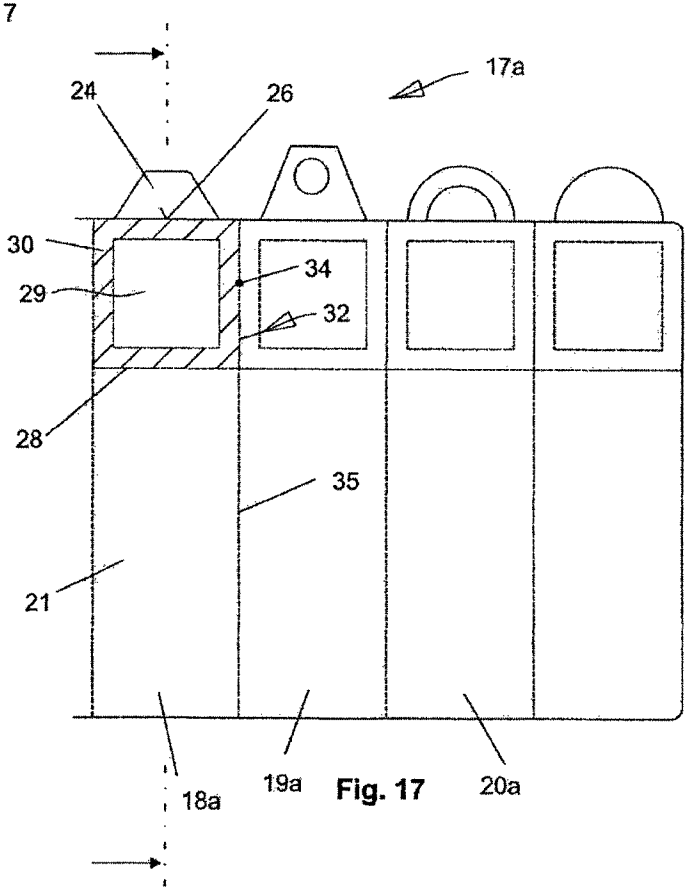
FIG. 17 is a plan view of the first embodiment of the label strip.

FIG. 17 shows, as a variant of the exemplary embodiment illustrated in FIG. 18, the other exemplary embodiment of a label strip 17*a*, which consists of the individual labels 18*a*, 19*a* at 20*a*, and wherein in the vicinity of a continuous parting edge 32, an edge part 34 is defined that is located in the vicinity of the closing sheet 23 and is continued into the edge part 35 that extends downward.

Different pull tabs 24 can be present in any shape desired.

The middle edge part 34 therefore extends between the intersecting points 36 and 37. It must then be ensured that during the separation of the individual labels 18, 19, 20 or 18*a*, 19*a*, 20*a* along the edge part 34, in no case is the peripheral area 30 that is sealed all around damaged.

To solve this problem, the invention teaches a variety of measures that will be described in greater detail below.

Figure 19:
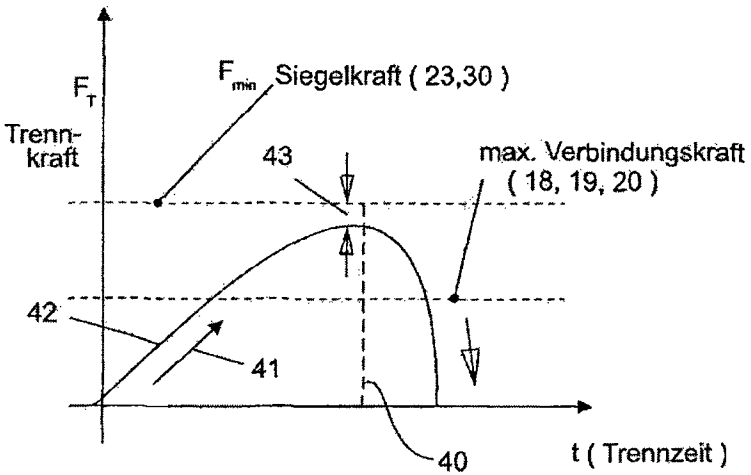
FIG. 19 is a schematic illustration of the flow of forces of the separating force during the tearing of the sealing surface in the vicinity of the closing sheet.

FIG. 19 shows a diagram of forces in which the parting force FT is plotted on the ordinate and the parting time t that is required to separate the connection between the individual labels is plotted on the abscissa.

At the zero point of the coordinate system, the parting force FT in the form of a peeling force 42 begins to act. It increases in the direction of the arrow 41 and in any case must exceed the maximum connecting force between the individual labels 18, 19, 20 in the vicinity of the edge part 34 to guarantee a separation of the edge part 34.

A force differential 43 is indicated as the difference between the maximum connecting force and the minimum sealing force in the vicinity of the container opening 14 in the surrounding peripheral area 30 that must in any case be overcome for the peeling force 42 to be effective. Therefore, there must always be a force differential 43 that maintains a safety margin to guarantee that the minimum sealing force SS is always greater than the parting force FT.

The edge part 34 is therefore torn at the parting point 40, without overcoming the minimum sealing force or adhesive force in the surrounding peripheral area 30.

Figure 20:
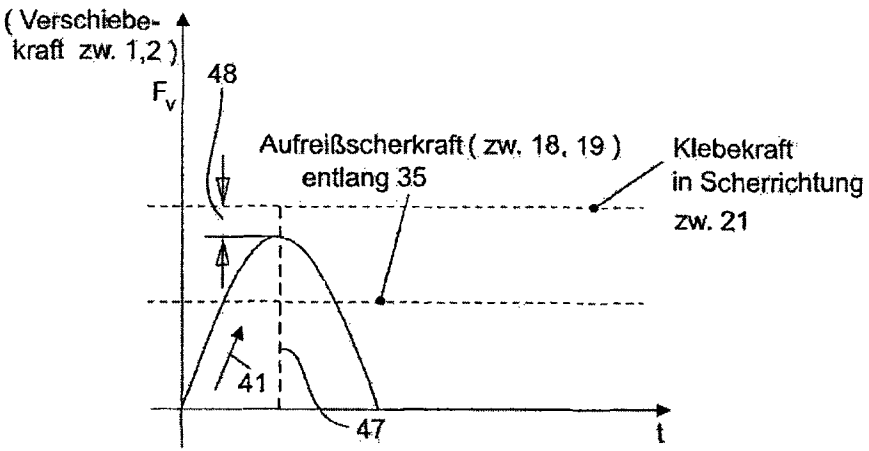
FIG. 20 is an equivalent illustration showing the displacement force during the counter-rotational movement of the individual packages with the goal of separating the label strip in the vicinity of the longer parting line.

FIG. 20, on the other hand, illustrates the relative movement of the edge parts 33 and 35 that run in the longitudinal direction, wherein the displacement force between the individual packages 1, 2, starting from the zero point of the coordinate system acts in the direction indicated by the arrow 41 and the displacement force is selected so that the tear strength along the edge part 35 and 33 is exceeded, so that these edge parts tear off. The tear strength along the edge parts 33 and 35 is then exceeded and the edge parts are thus separated from each other because the force relationships illustrated in FIG. 19 with reference to the center edge part 34 must be preserved.

The force differential 48 shows that the adhesive force in the shear direction that the backing sheet 21 has on the front and back sides 44, 45 is not exceeded. In other words, the label must remain adhering to the front and back sides and only the edge part 33, 35 is torn off. A separation between the edge parts 33, 35 attached to each other therefore occurs at the parting point 47.

Figure 24:
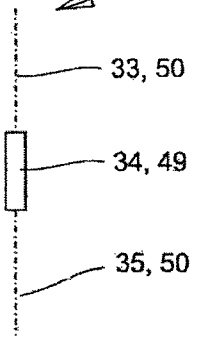
FIG. 24 shows a fourth embodiment for the configuration of a parting edge on the first label form.

FIGS. 21 to 26 show different embodiments of parting edges 32 of this type. In the embodiments illustrated in FIGS. 21 to 23, the parting edge 32 of a label strip 17*a* is shown, while FIG. 24 shows a parting edge 32*c* for a label strip 17.

Figure 21:
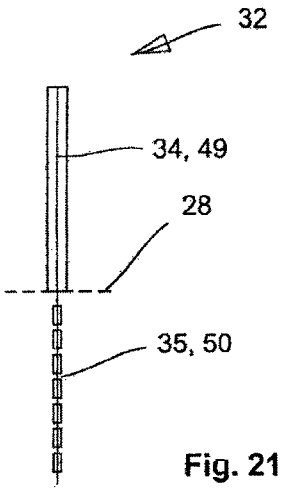
FIG. 21 shows a first embodiment for the configuration of a parting edge of this type.

FIG. 21 shows that the critical edge part 34 can be formed by an open perforation 49 that extends to the folded edge 28. The open perforation 49 is accordingly always open on the end and transitions downward into a perforated edge part 35 that has the perforation 50.

The perforation can be in different embodiments. It can include spot punchouts, linear punchouts or any other type of punchouts. It can also be in the form of microperforation.

Figure 22:
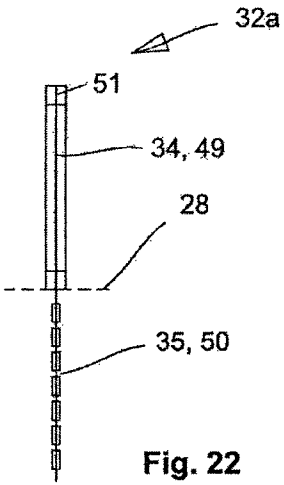
FIG. 22 shows a second embodiment for the configuration of a parting edge.

In the exemplary embodiment illustrated in FIG. 22, on the other hand, the open perforation 49 is always closed on the end by means of connecting webs 51, so that when the entire parting edge 32 is torn off, first the two facing connecting webs 51 must be torn off before the open perforation 49 can be opened and then the subsequent peeling force continues into the perforation 50 of the lower edge part 35.

Figure 23:
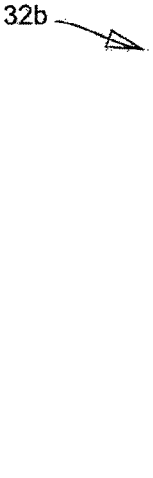
FIG. 23 shows a third embodiment for the configuration of a parting edge.

FIG. 23 shows a variation of the exemplary embodiment illustrated in FIG. 22, in which, instead of a continuous open perforation 49 with top and bottom end-side connecting webs 51, the connecting webs can extend parallel and at a distance from one another across the open perforation 49, so that there are empty spaces between them as the open perforation 49.

FIG. 24 shows an individual label of the type provided for a label strip 17, wherein all the explanations of FIGS. 21 to 23 above also apply for the edge part 34 shown there. It is shown purely by way of example that the open perforation 49 is continuous, although all the other embodiments illustrated in FIGS. 21 to 23 can be used. It is also shown that the rear edge part 33, which is likewise provided with a perforation 50, is also adjacent to the bottom perforated edge part 35.

Figure 25:
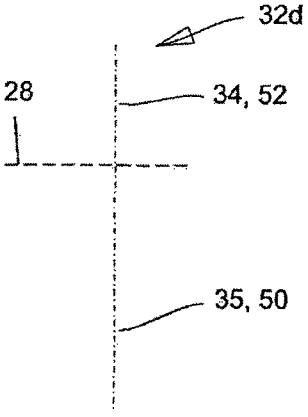
FIG. 25 shows a fifth embodiment of a parting edge for the second type of label.

In the exemplary embodiment illustrated in FIG. 25, instead of an open perforation 49, there can also be a perforation section 52 in the vicinity of the critical edge part 34, wherein this perforation section 52 is preferably in the form of microperforation. Otherwise, the same reference numbers are used for the same parts.

Figure 26:
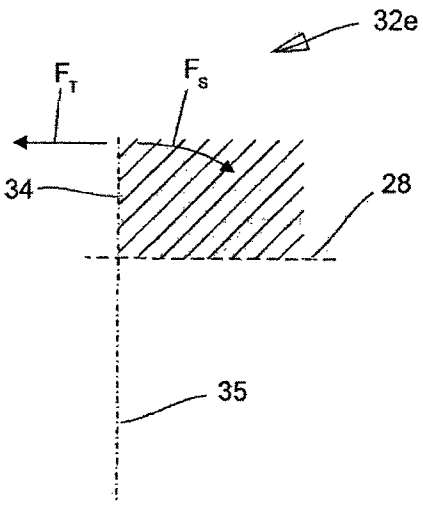
FIG. 26 is a schematic illustration of the force relationships during the separation of the label in the vicinity of the closing sheet.

FIG. 26 is a schematic illustration of a tearing process in a lateral view, when a label strip with an individual label illustrated in FIG. 25 is torn off. It is apparent that the separation force FT to the left must result in a tearing of the edge part 34, while in the neighboring part the adhesion force FS must be maintained, to prevent a tearing of material in the neighboring area.

Figure 27:
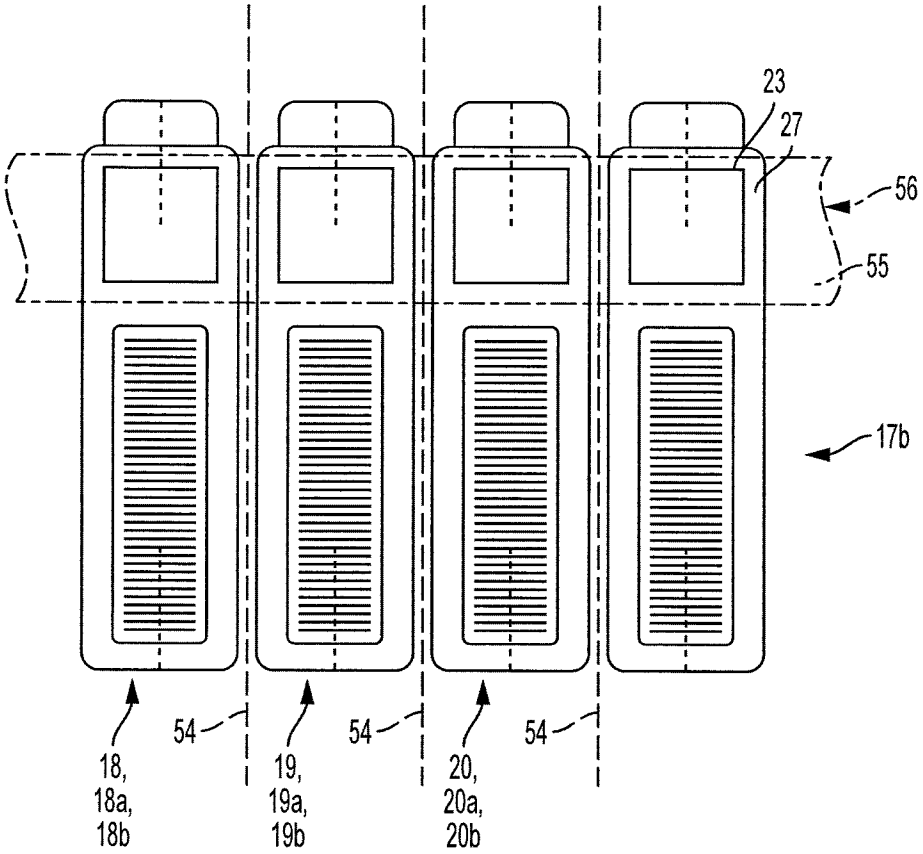
FIG. 27 shows an additional embodiment of a label strip.

FIG. 27 illustrates an additional exemplary embodiment for labeling a packaging block 3-5. To simplify the description, only the label strip 17*b* according to the invention is illustrated, which is characterized by the fact that in a prior step, the individual labels that are oriented parallel next to one another and are attached to one another are completely separated from one another by cut lines 54. Therefore, they are no longer connected at any point. To guarantee the secure positioning of the individual labels that have already been separated, the individual labels are fixed in position by an auxiliary strip 55 before, during or after the application of the cut lines 54.

It is preferable if the auxiliary strip 55 is adhesively connected with its longitudinal dimension above and across the individual labels arranged parallel and detached next to one another with its underside adhesive surface 56 so that it covers the sealable closing sheets 23. It is especially important to secure them in position in this area because the covering sheets 23 must be sealed with their sealable undersides in the proper position on the container edge 12 surrounding the container openings 14.

It is therefore preferred if, during the sealing process, the auxiliary strip 55 remains on the individual labels. Otherwise, all the individual labels 18, 19, 20; 18*a*, 19*a*, 20*a*; 18*b*, 19*b*, 20*b* that are explained in greater detail above can be used.

Instead of the use of a single auxiliary strip 55, which is preferably adhesively attached so that it runs over all the individual labels in the vicinity of their closing sheets, in another embodiment of the invention, the auxiliary strip can either be adhesively attached in another position over all the individual labels or more than one auxiliary strip can be used.

After the closing sheets 23 of the individual labels have all been sealed on the container openings 14, the at least one auxiliary strip 55 can be peeled off before, during or after the sealing process.

The projecting additional sealable parts of the individual labels can then be adhesively connected to the other surfaces of the individual package with a suitable application tool.

One advantage of the technical teaching of the independent claim 15 and of the additional claims that make reference to it is that when the labeled individual packages 1, 2 are separated from the packaging block 3, 5, there is no longer any danger that a tearable parting edge between the individual labels will damage the neighboring label, because the parting edge is no longer there.

NOMENCLATURE

1 Individual package
2 Individual package
3 Packaging block
4
5 Packaging block
6 Connecting element
7 Connecting element
8 Groove
9 Counter element
10 Push-in holder
11 Parting joint
12 Container edge
13 Coating
14 Container opening
15 Holding plate
16 Board frame
17 Label strip a
18 Individual label a, b
19 Individual label
20 Individual label
21 Backing (front)
22 Identification strip
23 Closing sheet
24 Tear-off tab
25 Backing (back)
26 Folded edge
27 Coating (seal)
28 Folded edge; 28*a* (back)
29 Membrane surface
30 Peripheral area
31 Open area
32 Parting edge
33 Edge part (rear)
34 Edge part (top)
35 Edge part (front)
36 Intersection point
37 Intersection point
38 Adhesive layer
39 Coating (adhesive)
40 Parting point
41 Directional arrow
42 Peel force (on 24)
43 Force differential
44 Front side (of 1, 2)
45 Back side (of 1, 2)
46 Side surface
47 Separation point
48 Differential
49 Open perforation
50 Perforation
51 Connecting web
52 Perforation section (top)
53 Directional arrow
54 Cut line
55 Auxiliary strip
56 Adhesive surface

The invention claimed is:

1. A package block comprising:

a plurality of individual packages that can be mechanically coupled and separated from one another by a shear force acting along respective parting joints, each of the plurality of individual packages having an opening on one end surrounded by container edges; and a continuous label strip for sealing the opening of each of the plurality of individual packages medically tight, wherein the continuous label strip comprises individual labels connected to one another across parting edges, the parting edges aligned with the parting joint between the plurality of individual packages, wherein each individual label comprises a front backing which adheres adhesively to a front side of each of the plurality of individual packages, and is adjacent to a closing sheet that seals the opening via a folded edge, and wherein a parting strength of an edge part of the parting edge in the area of the closing sheet covering the opening of each of the plurality of individual packages is sized so that when the individual label is separated at the parting edge, the adhesive strength of the closing sheet on the encircling container edges is not exceeded.

2. The package block of claim 1, wherein the parting edge is continuous over an entire length of the parting edge between the individual labels lined up side-by-side in a row with one another.

3. The package block of claim 1, wherein adherence properties of the individual labels to surfaces of the individual packages are different, in connection with a tear force on different edge parts of the parting edge.

4. The package block of claim 1, wherein the individual packages lined up side-by-side in a row can be separated from one another in a direction of a longitudinal axis therebetween or in a direction of a transverse axis by a counter-rotation movement, and wherein a shear force effects tearing of the parting edge over the entire length.

5. The package block of claim 1, wherein a top closing sheet is adjacent a rear folded edge to a backing that adhesively covers a backside of each of the plurality of individual packages.

6. The package block of claim 5, wherein a pull tab is located on a rear portion of the closing sheet or on the rear backing.

7. The package block of claim 1, comprising three or more individual packages.

8. A label strip for a package block, wherein the package block comprises a plurality of individual packages that can be mechanically coupled and separated from one another by a shear force acting along respective parting joints, and can be sealed medically tight at least proximate to individual package openings by the label strip, the label strip comprising:

a continuous parting edge between individual labels of the label strip, wherein the continuous parting edge comprises a top edge part, a middle edge part, and a lower edge part, wherein the top edge part and the lower edge part have identical first separation properties, and the middle edge part associated with a sealable closing sheet and has a second separation property such that a separation force required for separation of the middle edge part at the sealable closing sheet is less than a separation force required for separation of the top and bottom edge parts.

9. The label strip of claim 8, wherein the middle edge part is formed by an open perforation that extends to a folded edge.

10. The label strip of claim 9, wherein the open perforation is bordered on an end side by tearable connecting webs.

11. The label strip of claim 8, wherein the top and bottom edge parts of the parting edge are formed by microperforations.

12. A package block comprising:

a plurality of individual packages that are mechanically coupled to one another and can be separated from one another by a shear force acting along respective parting joints, each of the plurality of individual packages having an opening on one end surrounded by container edges; and a continuous label strip for sealing the opening of each of the plurality of individual packages medically tight, wherein the continuous label strip comprises individual labels separated from one another by cut lines, wherein the cut lines of the individual labels are aligned with the parting joints between the individual packages, and wherein an auxiliary strip is adhesively attached temporarily to an upper side of the individual labels proximate the opening of the individual packages, and wherein the auxiliary strip is attached at least as long as the individual labels are not completely sealed on the individual package openings of the package block.

13. The package block of claim 12, comprising three or more individual packages.

14. A continuous label strip for a package block, wherein the package block comprises individual packages that can be mechanically coupled and separated from one another by a shear force acting along a parting joint, and can be sealed medically tight at least proximate to individual package openings by the continuous label strip, the continuous label strip comprising:

individual labels separated from one another by cut lines, wherein the cut lines are aligned with the parting joints between the individual packages, and wherein an auxiliary strip is adhesively attached temporarily to an upper side of the individual labels proximate the opening of the individual packages, and wherein the auxiliary strip is attached at least as long as the individual labels are not completely sealed on the individual package openings of the package block.

15. A method for labeling a package block with a continuous label strip, the method comprising:

individual labels of the continuous label strip, which are connected with each other along their longitudinal edges, are separated from one another along cut lines, to secure the separated individual labels in position, at least one auxiliary strip is adhesively attached to an upper side of the separated individual labels proximate a sealable closing sheet of the individual label before, during or after the separation, the individual labels, which are held together in secure positions by the auxiliary strip, are laid with a bottom side of the sealable closing sheets in contact with edges on container openings of individual packages of a package block and sealed, additional adhesively attachable parts of the individual labels are adhesively attached with appropriate applicator tools on a front side and optionally a back side of the individual packages, and the auxiliary strip is removed before or during or after the additional adhesively attachable parts of the individual labels are adhesively attached.

* * * * *